United States Patent [19]

Gallin

[11] 4,247,958

[45] Feb. 3, 1981

[54] UNIFORM CAP WITH CHANGEABLE COVER

[75] Inventor: Paul G. Gallin, Bronxville, N.Y.

[73] Assignee: Art Cap Company, Inc., New York, N.Y.

[21] Appl. No.: 62,768

[22] Filed: Aug. 1, 1979

[51] Int. Cl.[3] ..... A42B 1/02; A42C 5/00

[52] U.S. Cl. ..... 2/187; 2/195

[58] Field of Search ..... 2/187, 195, 199, 171.1, 2/209.7

[56] References Cited

U.S. PATENT DOCUMENTS 4,062,063 12/1977 Bloom ..... 2/187

4,097,934 7/1978 Weinstein ..... 2/195

*Primary Examiner*—Peter P. Nerbun

*Attorney, Agent, or Firm*—Curtis Ailes

[57] ABSTRACT

In a cap of the type having a cap frame including a head band and a visor and a vertical stay and a grommet for supporting the top of the cap and a separable changeable cap cover covering the stay and the grommet and surrounding and covering the head band, the changeable cap cover includes a lower band portion surrounding the head band which is comprised of elastic and having an unstretched inner circumference smaller than the outer circumference of the head band to provide a stretch fit over the head band.

6 Claims, 3 Drawing Figures

UNIFORM CAP WITH CHANGEABLE COVER

The present invention relates to uniform caps of the type having changeable cap covers.

In caps which are used with uniforms by the armed services, as well as by peace officers, and others who must wear uniforms, it is often desirable to provide for changeable cap covers. The changeable cap covers provide for a change in the uniform without the necessity for providing a number of different caps. The changeable cap cover also provides a means for renewing the cap without the necessity of purchasing an entire new cap.

Up until the present time, the cap covers have never provided an absolutely perfect fit over the head band of the cap frame, and furthermore, in order to obtain a reasonably good fit, it has been necessary to provide just as many sizes of cap covers as there are cap sizes. Still further, it has been customary to anchor the cap covers to the cap frame by means of buttons protruding from opposite sides of the head band of the cap frame, and to provide button holes in the sides of the lower band portion of each cap cover. This means of anchoring the cap cover has not always been completely satisfactory because the fit has been relatively loose, and the button holes for the anchoring buttons have been difficult to "line up" and have not always provided the best anchoring for the cover.

Accordingly, it is one object of the present invention to provide an improved uniform cap of the type having a removable cap cover in which the fit between the cap cover and the cap frame is substantially improved.

Another object of the invention is to provide an improved uniform cap of the type having a removable cap cover in which the means of attachment of the cap cover to the cap frame is substantially improved.

Another object of the invention is to provide an improved uniform cap of the type having a removable cap cover in which a single size of cap cover is capable of providing a perfect fit for a number of different sizes of caps.

Another object of the invention is to provide an improved uniform cap of the type having a removable cover in which the openings to accommodate for fastening buttons for anchoring the cap cover to the cap frame provide an additional decorative feature of the cap cover as well as providing the function of accomplishing the anchoring.

Further objects and advantages of the invention will be apparent from the following description and the accompanying drawings.

In carrying out the invention in a preferred embodiment thereof there is provided a uniform cap of the type having a cap frame including a head band and a visor and a stay and a grommet for supporting the top of the cap and a separable changeable cap cover covering said stay and said grommet and surrounding and covering the central and upper portions of said head band, wherein said changeable cap cover includes an enlarged upper crown portion having a substantially flat top and a lower band portion surrounding said head band, said band portion being comprised of elastic and having an unstretched inner circumference smaller than the outer circumference of said head band so as to provide a stretch fit over said band.

Figure 1:
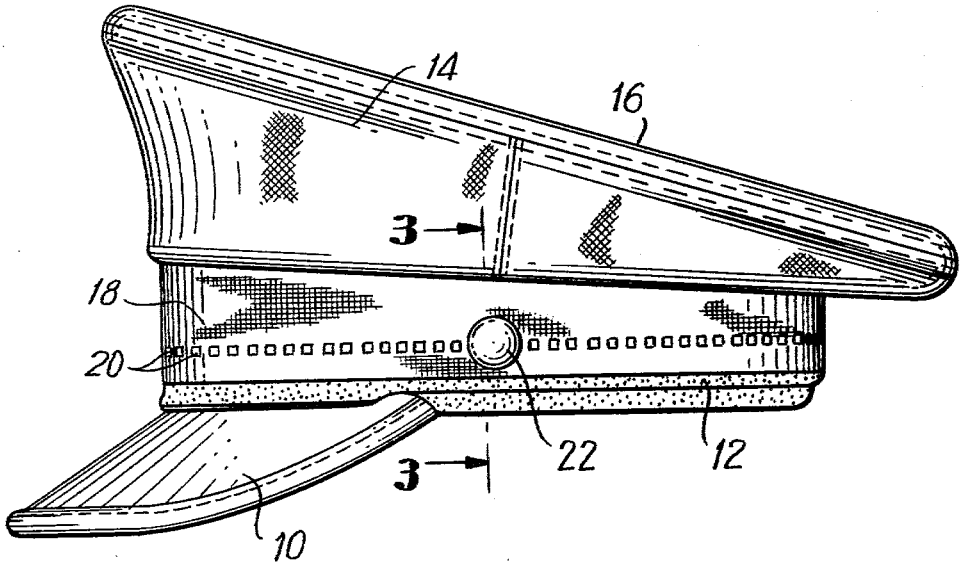
FIG. 1 is a side view of a preferred embodiment of the invention.

Referring more particularly to FIG. 1, there is shown in a side view a preferred embodiment of the uniform cap in accordance with the present invention. This is recognizable as a cap of the type used by the armed forces, and by peace officers, as well as others who are required to wear uniforms, such as firemen and uniformed guards and security officers.

Figure 2:
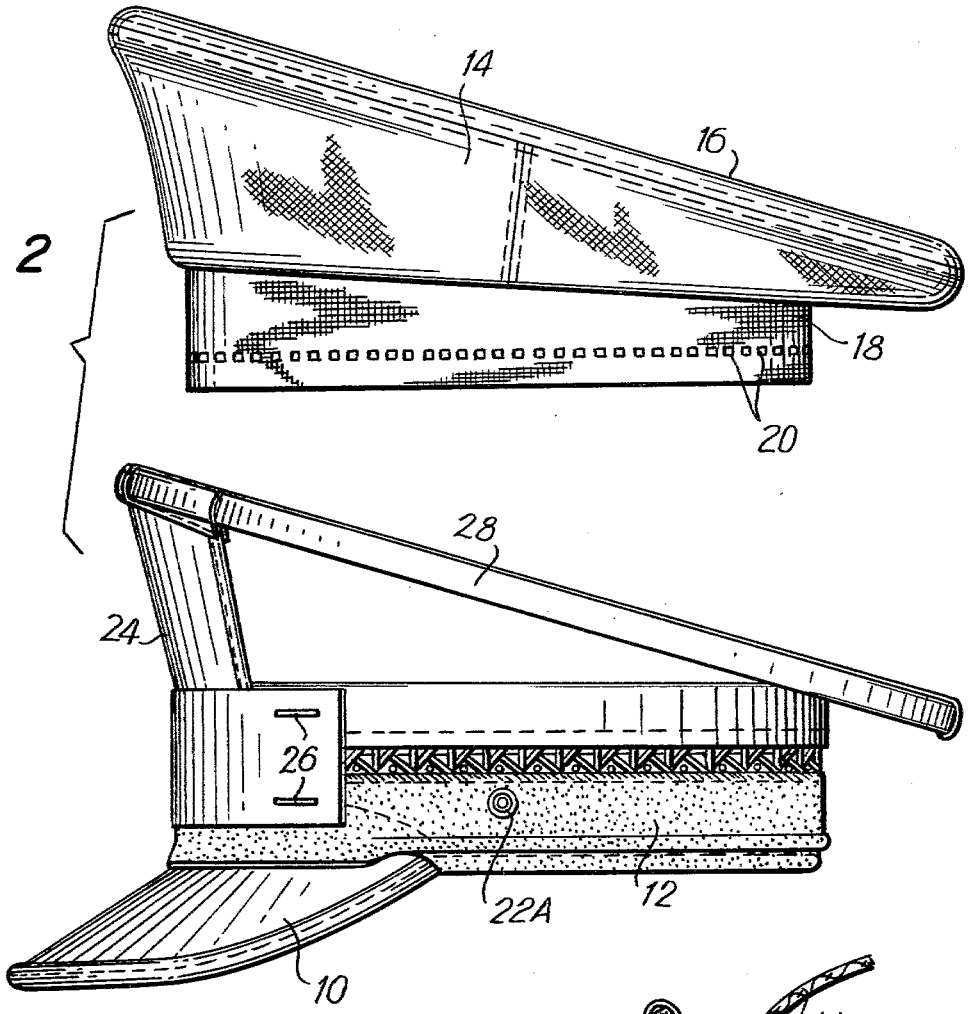
FIG. 2 is an exploded view showing the removable cap cover separated from the cap frame.

The cap is seen to include a visor 10 and a head band 12, both of which form part of the cap frame illustrated separately in FIG. 2. The cap also includes a cap cover 14. It is seen that the cap cover includes an enlarged upper crown portion having a substantially flat top 16 and a lower band portion 18 surrounding the head band 12. In accordance with the present invention, the band portion 18 is comprised of elastic and has an unstretched inner circumference smaller than the outer circumference of the head band 12 so as to provide a stretch fit over the head band. The elastic of the lower band portion 18 is sufficiently elastic so that a single size of cap cover is stretchable over a number of different sizes of head bands so that a smaller inventory of cap covers can be maintained to satisfy demands for new cap covers.

A circumferential row of openings 20 is provided in the elastic lower band portion 18 of the cap cover. These openings 20 provide a decorative feature to the cap cover and also serve the utilitarian purpose of accommodating an anchoring button 22 provided on the side of the cap. The means of attachment of the button 22 is illustrated in detail in FIG. 3 and explained below in connection with that figure FIG. 2 is an exploded view showing the cap cover 14 removed from the cap frame. It is seen that the cap frame includes, in addition to the visor 10 and the head band 12, a vertical stay member 24 arranged at the front of the cap and attached to the head band 12 by means such as metal staples indicated at 26. Attached at the top of the vertical stay 24 is a grommet 28 which fits into the upper crown portion of the cap cover when the cap cover is assembled to the cap frame. The cap cover 14 thus surrounds the stay 24, the grommet 28, and substantially surrounds and covers the head band 12.

Figure 3:
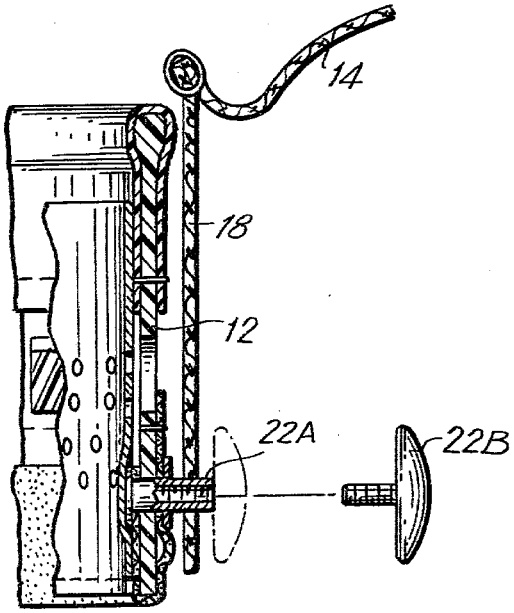
FIG. 3 is an enlarged partial cross sectional view taken at section 3—3 of FIG. 1.

As illustrated in the sectional view of FIG. 3, the anchoring button 22 preferably consists of a screw back button 22B which is threadedly attached to a stud 22A, which is in turn permanently attached to the head band 12. In FIG. 2, the screw back button 22B has been removed, to reveal the stud 22A.

By installing the screw back button 22B after the assembly of the cap cover 14 over the cap frame, the elastic band 18 of the cap cover need not be substantially stretched to open the hole 20 through which the stud 22 is threaded in order to secure the cap cover to the head band. Thus, openings 20 in the elastic band 18 can be kept relatively small, and the row of openings 20 attractive, even while one pair of the opening 20 is used for the highly utilitarian purpose of anchoring the cover to the buttons 22.

As illustrated in FIGS. 1 and 2, the holes or openings 20 in the band portion of the cap cover are preferably evenly spaced, and preferably extend around the entire circumference of the band portion. The openings are preferably fairly closely spaced so as to give the appearance when taken together of forming a decorative stripe. Furthermore, the openings 20 are preferably square in shape, but from a functional standpoint, the shape of the holes is not critical. The close spacing of the holes 20, in combination with the elastic material of the band 18, means that there is never any problem in aligning a pair of the holes to fit over the studs 22A.

Also, as illustrated in the drawings, the holes 20 are arranged at a uniform dimension from the lower edge of the band portion of the cap cover and relatively near that edge.

The elastic of the elastic band portion of the cap cover may be assembled in various ways, while still fulfilling the desired functions of the invention. However, in a preferred form of the invention, the specification on the elastic band is as follows:

Warps: 25 Ends 1/150 O.B. polyester
Total Warp Ends: 25
Filler:
9 Ends 2/150/30 O.B. polyester
1 End 1/150 O.B. polyester
Elastic Element: 25 Ends 840 lycra
Finished Picks/Inch: 26
Elongation: 20%
Needle Width: 26 needles The resultant width of the finished elastic band portion is about 4.5 centimeters, and the row of openings 20 is about 0.9 centimeters from the lower edge of the band. The openings 20 are preferably about 2 mm. square.

While this invention has been shown and described in connection with a particular preferred embodiment, it is apparent that various changes and modifications, in addition to those mentioned above, may be made by those who are skilled in the art without departing from the basic features of the invention. Accordingly, it is the intention of the Applicant to protect all variations and modifications within the true spirit and valid scope of this invention.

I claim:

1. A uniform cap of the type having a cap frame including a head band and a visor and a stay and a grommet for supporting the top of the cap and a separable changeable cap cover covering said stay and said grommet and surrounding and covering the central and upper portions of said head band, wherein said changeable cap cover includes an enlarged upper crown portion having a substantially flat top and a lower band portion surrounding said head band, said band portion being comprised of elastic and having an unstretched inner circumference smaller than the outer circumference of said head band so as to provide a stretch fit over said head band, at least two buttons extending radially outwardly on opposite sides of said head band, said band portion of said cap cover including a large number of holes evenly spaced in a single line around the circumference of said band portion with at least two of said holes being arranged at approximate circumferential positions corresponding to the positions of said buttons and arranged to be threaded over said buttons to hold said cap cover securely upon said head band.

2. A uniform cap as claimed in claim 1 wherein said holes are evenly spaced from the lower edge of said band portion to match the elevation positions of said buttons.

3. A uniform cap as claimed in claim 2 wherein said holes provided in said elastic band portion are substantially square in shape.

4. A uniform cap as claimed in claim 3 wherein said elastic band portion of said cap cover is provided with sufficient elasticity to accommodate a number of different head band sizes with a single cap cover size.

5. A uniform cap as claimed in claim 3 wherein said holes are arranged near the lower edge of said elastic band portion.

6. A uniform cap as claimed in claim 1 wherein said buttons each comprise a screw stud rigidly attached to said head band and a screw back button threadedly attachable to said stud, said stud being threadable into the most convenient one of said series of holes in said elastic band portion of said cap cover before installation of said screw back button.

* * * * *